US005465599A

United States Patent [19]

Lee, Jr.

[11] Patent Number: 5,465,599

[45] Date of Patent: Nov. 14, 1995

[54] CAN FLANGER HAVING BASE PAD WITH STOP SPACER ARRANGEMENT DETERMINING A WORKING SPRING GAP

[75] Inventor: Harry W. Lee, Jr., Chesterfield County, Va.

[73] Assignee: Reynolds Metals Company, Richmond, Va.

[21] Appl. No.: 242,493

[22] Filed: May 13, 1994

[51] Int. Cl.[6] ..... B21D 19/04

[52] U.S. Cl. ..... 72/94; 72/125; 72/465

[58] Field of Search ..... 72/94, 125, 126, 72/420, 465, 352

[56] References Cited

U.S. PATENT DOCUMENTS

| | | | |
|---|---|---|---|
| 3,262,297 | 7/1966 | Samuels et al. | 72/125 |
| 3,812,696 | 5/1974 | Kneusel et al. | 72/352 |
| 4,272,977 | 6/1981 | Gombas | 72/94 |
| 4,437,327 | 3/1984 | Madden | 72/94 |

*Primary Examiner*—Lowell A. Larson
*Attorney, Agent, or Firm*—Robert C. Lyne, Jr.

[57] ABSTRACT

A flanging apparatus includes a flanging head assembly having a cluster of freely rotatable spin flanging rollers and a stop ring against which the flange hits during the final flange forming stages to limit the flange to a specific diameter. To prevent the flange from entering the crack formed between the rotating roller and the stationary stop ring, there is provided a step spacing the stop ring surface from the roller forming surface. The forming process occurs as a result of spring biased relative axial movement of the can open end toward the forming surfaces, caused by contact between the can bottom with a base pad movable in a working stroke toward the flanging rollers with a cam controlled spindle. A spring extends between the base pad and a base pad spring collar attached to the spindle to create a predetermined spring force which is normally applied throughout the flange forming process. However, in the event that the predetermined spring force is insufficient to ensure full contact of the can open end with the complete flange forming surface, a gap formed between the base pad spring collar and the base pad is operable to close so that the force now urging the can open end against the stop surface and the flange forming surfaces is greater than the predetermined spring force. As the can open end is deformed to a sufficient extent, the predetermined spring force once again overcomes the axial resistance of the can so as to complete the flange forming process.

20 Claims, 3 Drawing Sheets

CAN FLANGER HAVING BASE PAD WITH STOP SPACER ARRANGEMENT DETERMINING A WORKING SPRING GAP

TECHNICAL FIELD

The present invention relates generally to mechanisms for flanging an open end of a metal can or other container and, more particularly, to a spinning flanging head coacting with a stationary stop ring and a base pad to control and flange the open end.

BACKGROUND ART

Metal cans or containers, such as aluminum cans to contain beverages, are commonly manufactured by drawing and ironing a circular metal blank into a cylindrical can body having a side wall and a bottom wall. Such cans are then fed into necking and flanging apparatus by transfer or star wheels. Each can enters one of a number of stations in a necking turret undergoing rotational movement which is synchronous with the continued movement of the cans in the star wheel. During this rotational movement, the peripheral edge portion of the can side wall is formed by annular die members or spin forming members to form a neck of reduced diameter at the open end of the can. The necked cans are then transferred via transfer wheels to a flanging turret where the open edge of the can is flanged into a radially outward directed flange suitable for later receiving a can end in a known manner. The arrangement of drawing and ironing machines for forming the can bodies, and machines containing necking and flanging turrets are well known in the art.

A plurality of flanging heads are typically circumferentially spaced at the periphery of the flanging turret. Each flanging head has plural flanging rollers or spinners freely rotatably supported about their respective longitudinal axes in a central housing or cage. The cage is rotatable about its central longitudinal axis so that the flanging rollers revolve therearound in planetary relationship during flanging. Each flanging head typically includes an outer housing formed with a mounting flange adapted to be bolted to a mounting disk attached to the flanging turret, as is well known. The central housing containing the flanging rollers is rotatably disposed in the outer housing with ball bearings. A splined shaft projecting rearwardly from the outer housing is attached to the central housing to impart rotational movement about the central longitudinal axis via meshing contact with gearing disposed within the flanging turret.

The front of the flanging head is defined by a stop ring 100 (depicted in prior art FIG. 1) bolted to the outer housing. A retainer plate sandwiched between the stop ring and ball bearing elements assists in maintaining the forming surface 120 of each flanging roller 140 in operative alignment with the stop surfaces 160 on the stop ring 100. As the flanging heads rotate, the marginal necked free edge portion 180 of the can is advanced into contact with the rotating cluster of flanging rollers 140. Since the can does not rotate, contact between the marginal end 180 with the revolving rollers 140 induces free rotation of each roller which results in spinning contact and flange formation as the open end of the can contacts the progressively larger diameter portions 200 of each roller. These progressively larger diameter portions 200 cause corresponding enlargement of the can end and deflection of the metal into a flange 220 extending approximately perpendicular to the longitudinal axis of the can.

As the formed flange 220 is in its final forming stages during final camming movement of the can against the rotating rollers 140, the flange end contacts the stop surfaces 160 of the stationary stop ring 100, whose purpose is to stop the flange 220 at a specific preselected diameter so that the flange has the same width along all sides of the can. In practice, however, the annular flange 220 usually strikes one side of the surface 160 before it hits all sides. When this happens, it usually takes only a small additional force to disadvantageously force the flange into the crack 240 formed between the rotating roller 140 and the stationary stop ring 100. When this occurs, the can is ruined and must be scrapped, since the metal forced into the crack 240 forms a sharp vertical ear on the can flange 220.

FIG. 2 is an illustration of a flanging roller and stepped stop ring arrangement which overcomes this problem, as disclosed in U.S. Pat. No. 5,235,839, to Lee, Jr. et al, assigned to Reynolds Metals Company, Richmond, Va., the assignee of the present invention. Therein, an apparatus for flanging cans includes a flanging head assembly having a cluster of freely rotatable spin flange rollers 12 and a stop ring 26 against which the flange 66 hits during the final flange forming stages to limit the flange to a specific diameter. To prevent the flange 66 from entering a crack formed between each rotating roller 12 and the stationary stop ring 26, there is provided a step 102 spacing the stop ring surface 70 from the roller forming surface. In this manner, as the terminal edge 68 of the flange 66 slides around the flanging roller 12 during final forming, it will pass over the crack 72 and across the step 102 to lodge in a corner 85' formed between the step and stop ring surface. The step 102 is preferably a conical surface extending from the stop ring surface 70 in a direction away from the can bottom. This conical surface extends radially inwardly a sufficient distance to contact unsupported flange portions 110 between the flanging rollers 12 to limit the degree of elastic sagging of these portions. The relevant disclosure of U.S. Pat. No. 5,235,839 is incorporated by reference herein in its entirety.

The stop ring flanger depicted in FIG. 2 does an excellent job in flanging the free edge portions formed in can bodies, particularly those can bodies formed by a process known as spin flow necking such as disclosed in U.S. patent application Ser. No. 07/929,933, filed Aug. 14, 1992, also assigned to Reynolds Metals Company, Richmond, Va., the assignee of the present invention. Spin flow necking is a process of necking in an open end of a metal can to provide an outwardly flared open end which is then flanged, such as with a flanging apparatus as disclosed in the '839 patent, to allow a can end to be seamed thereto after filling.

The flanging apparatus of the '839 patent does an excellent job in reforming both the spin flow and other types of necked-in cans to produce a uniform plug and a uniform flange width from cans that have a wide variety of flange widths and plug diameters prior to flanging. However, there is another dimensional variation that shows up in all cans, including spin flow cans, which is a variation in the trim or pre-necked can height. This variation can be allowed for in the flanging apparatus by utilizing a spring-loaded base pad assembly which is pre-loaded to a predetermined spring force that is necessary to flange the can without creating an excessive flanging force.

With reference to FIG. 3, the spring-loaded base pad assembly 150 is generally comprised of a base pad 152 adapted to contact the can bottom 154, and a spring pad adjusting collar 156 interconnected to the base pad through a plurality of springs 158 having a predetermined spring force. A spindle or shank mechanism 160 is connected to the spring pad adjusting collar 156 and is cam controlled in a known manner to axially advance the open end 162 of the can body 164 in a forward stroke of the spindle 160 into flanging contact with the flanging rollers 12 by advancing the base pad 152 with the can bottom 154 seated thereon through the collar 156 and springs 158. The base pad assembly 152 is set so that when a can 164 of minimum height is flanged, the spring force is sufficient to flange the can and the spring-loaded base pad 152 may or may not be deflected rearwardly towards the spring pad adjusting collar 156. The shank or spindle mechanism 160, as mentioned above, is cam operated and adjusted to a forward position so as to apply this spring flanging force on the can.

When a spin flow can that is formed towards the maximum of the manufacturing tolerance range is flanged, the same spring force is required. However, this spring force tends to be reached slightly before the shank mechanism 160 has reached the forward end of its working stroke. This spring-loaded base pad 152 compensates by moving back a small amount (relative to the shank) against the predetermined spring force to allow the can to be flanged without applying unnecessarily high forces.

The combination of the stepped stop ring and the spring-loaded base pad do an excellent job in producing cans of high quality and consistency. However, a spin flow can is sometimes produced which, as a result of an improper adjustment or slippage in the spin flow necking mechanism or unusual metal properties or heat treatment of the can, has a larger than normal flange width, or plug diameter, or both. This type of can will usually first contact the stationary stop ring 26, as depicted in FIG. 4, instead of first contacting the spinning flanging roller forming surfaces **66*a* and then being forced to contact the stationary stop ring by the rotating spinner as depicted in FIG. 2. The shape of the can open end as depicted in FIG. 4 has a wide flaring flange 170 of about 60° from an axis L (parallel to the can longitudinal axis) which lodges into the corner 85' of the stationary stop ring 26. The shape of the partial flange on the can is such that it misses contacting the rotating spinners 12 entirely, or at best has only minimal contact with the tips of the forming surfaces on the spinners. As a result, the flared open end on the can is supported by the stationary stop ring 26 and is exceedingly strong to the point of overcoming the predetermined spring pre-load force of springs 158 which is generally set to be about 75–110 pounds. The flange depicted in FIG. 4 can support loads of about 150–200 pounds. The can is therefore sufficiently strong to overcome the pre-loaded springs 158 and thereby prevents the base pad 152 from completing its normal range of movement while allowing the shank mechanism 160** to complete its working stroke without reforming the can. As a result, the spin flow can passes through the flanging apparatus without being reformed. This can may end up on the finished can pallet and be shipped to a customer without being able to be seamed properly on a seamer. As a result, a filled can may be produced that could leak product at a later time.

It is accordingly one object of the present invention to provide an apparatus which ensures that all cans are manufactured with a uniform flange width and plug diameter.

Another object of the invention is to minimize the occurrence of improperly flanged cans from being filled and seamed in a manner that may subsequently produce product leakage.

Yet a further object is to provide a simple design modification to a flanging apparatus having a spring-loaded base pad to ensure proper flange forming.

DISCLOSURE OF THE INVENTION

The present invention is directed to improvements in flanging apparatus utilizing at least one flanging head assembly having profiled flange forming surfaces adapted to receive a free edge portion of a can body to form same into a flange by providing for substantially full contact with the flange forming surfaces during relative axial movement between the free edge portion and the forming surfaces. The flanging head assembly preferably uses a stop ring having a stop surface mounted adjacent a trailing end of the forming surfaces to contact the free edge portion to limit the diameter of the flange during forming. A base pad assembly is adapted to contact the can bottom and a spring arrangement is disposed in at least one of the flanging head assembly and the base pad assembly. A working spring gap is formed between opposing surfaces of the spring arrangement. At least one spring extends across the gap to transmit spring bias to the can, such that said relative axial movement causes forming to occur under a predetermined spring force which is normally sufficient to urge the free edge portion of the can into contact with the stop ring and into full contact with the profiled flange forming surfaces against the stopping action of the stop surface and without the gap being completely closed during a working stroke. In accordance with the invention, the opposing surfaces defining the gap are spaced from each other so that the gap is dimensioned to fully close when the predetermined spring force is insufficient to urge the free edge portion into contact with both the stop ring and into full contact with the forming surfaces. By closing the gap in this manner, one of the opposing surfaces contacts and moves the other opposing surface to continue the relative axial movement and thereby deflect the free edge portion into sufficient contact with the forming surfaces to initiate completion of full contact with the forming surfaces.

With the foregoing arrangement, the gap is operable to re-open as a result of a weakening in the axial resistance force of the can as the free edge portion begins to be curved into greater contact with the flange forming surfaces such that the resistance force gradually reduces to a force level which is less than the predetermined spring force.

The stop ring is preferably formed with a step which spaces the stop surface from the forming surfaces to enable the terminal end of the flange being formed to travel past an interface crack between the flange forming surfaces and the stop ring and across the step to contact the stop surface and avoid movement of a portion of the terminal end of the flange into the crack.

The spring arrangement, in the preferred embodiment, is disposed within the base pad assembly which includes a base pad adapted to contact the can bottom and a spring pad adjusting collar interconnected to the base pad through at least one spring creating the predetermined spring force. A cam operated spindle or shank mechanism is connected to the spring pad adjusting collar and is operable to axially advance the open end of the can body in the forward working stroke of the spindle into flanging contact with the forming surfaces by advancing the base pad with the can bottom seated thereon toward the flanging head assembly.

The predetermined spring force is preferably between about 75–110 pounds and the gap width is selected to be only slightly larger than the normal variation in finished can height. Therefore, the gap width is selected to be about 0.010 inches.

A method of forming a peripheral, outwardly directed flange in a free edge portion of a can having a cylindrical body is also disclosed. The method comprises the steps of positioning a can body in a flanging apparatus between a flanging head assembly and a base pad assembly contacting the can bottom. The free edge portion of the can open end is then flanged by creating relative axial movement between the free edge portion and profiled flange forming surfaces in the flanging head assembly under a resilient predetermined spring force transmitted to the can from at least one of the flanging head assembly and the base pad assembly and which is normally sufficient to urge the free edge portion into full contact with the profiled flange forming surfaces. In the event that the predetermined spring force is insufficient to urge the free edge portion into full contact with the flange forming surfaces, an overriding force which is greater than the predetermined spring force operates to continue the relative axial movement to thereby deflect the free edge portion into sufficient contact with the forming surfaces to initiate completion of full contact between the free edge portion with the forming surfaces.

Preferably, in accordance with the method, the free edge portion is deflected into sufficient contact with the forming surfaces under the action of the overriding force which is greater than the predetermined spring force. The overriding force forces the shape of the radially outward directed flange into a shape that is not as axially strong and eventually is weaker than the predetermined spring force. At this point, the base pad moves forward slightly faster than the cam operated spindle so that the predetermined spring force can ensure completion of full contact of the flange with the forming surfaces.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
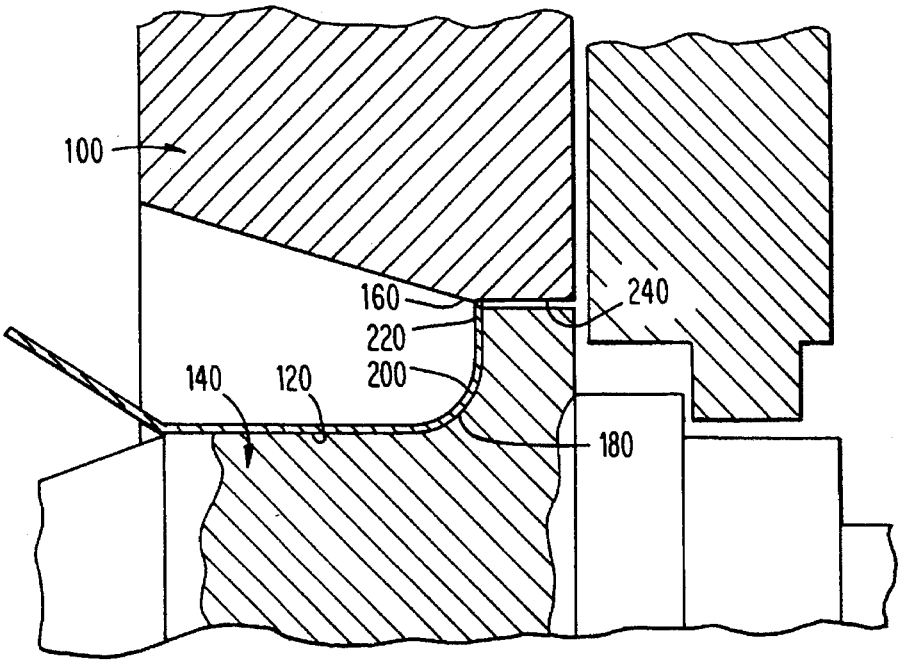
FIG. 1 PRIOR ART
FIG. 1 is an enlarged cross-sectional view of the interface typically formed between each of the spin flanging rollers with the surrounding stop ring in accordance with a flanging apparatus of the prior art.
Figure 2:
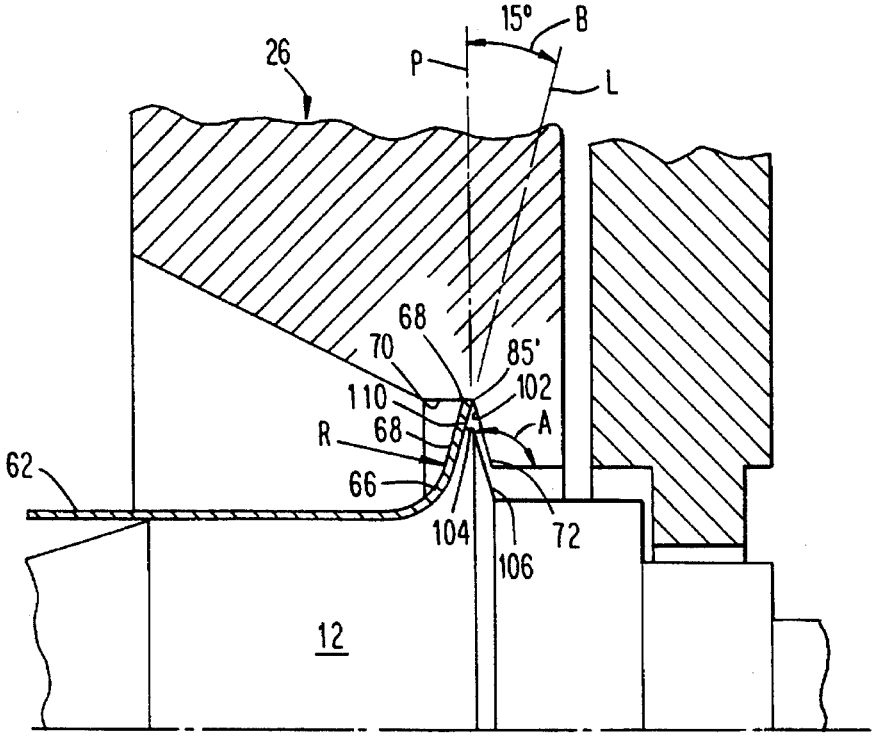
FIG. 2 is an enlarged sectional view of a portion of a flanging head and stop ring assembly as disclosed in FIG. 6 of U.S. Pat. No. 5,235,839.
Figure 3:
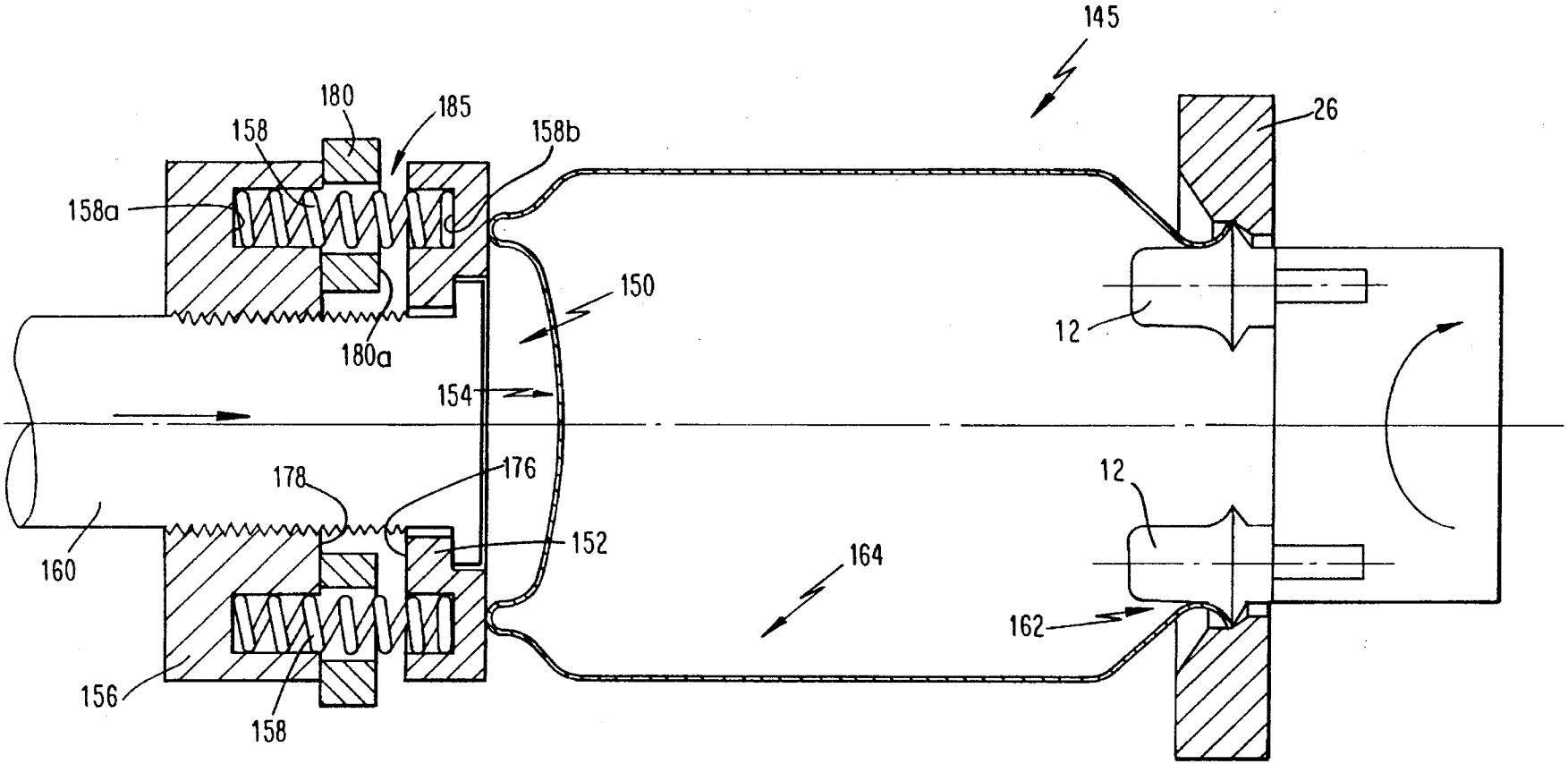
FIG. 3 is a sectional view of a base pad assembly in accordance with a preferred embodiment of the present invention, utilized in combination with the flanging head and stop ring assembly depicted in FIG. 2.

FIG. 3 is an illustration of a flanging apparatus 145 utilizing a base pad assembly 150 in accordance with the present invention, in preferred combination with a flanging head and stationary stop ring assembly of the type disclosed in FIG. 2, discussed supra. In the flanging apparatus 145 of this invention, flanging occurs by advancing the open end 162 of the can 164 with the cam controlled base pad assembly 150 into flanging contact with the rotating spinners 12 under a predetermined spring load which is typically 75–110 pounds. This predetermined spring force is transmitted to the can 164 through the substantially flat circular base pad 152 which is interconnected to the spring force adjusting collar 156 through a series of circumferentially spaced springs 158 having opposite ends respectively received in corresponding, coaxially aligned blind bores **158*a*, 158*b* formed in opposing surfaces 176 and 178 of the base pad and collar, respectively. A spindle or shank 160 fixed to the collar 156 is connected to a cam mechanism (not shown) in a known manner to advance the base pad assembly 150 forwardly in a working stroke of predetermined axial extent so that the free edge portion 66 lodges into the corner 85' of the stationary stop ring 26 and is held there so that it can be deformed into full contact with the flange forming surfaces 66*a* at the end of the forward working stroke and into the condition depicted in FIG. 2**.

Figure 4:
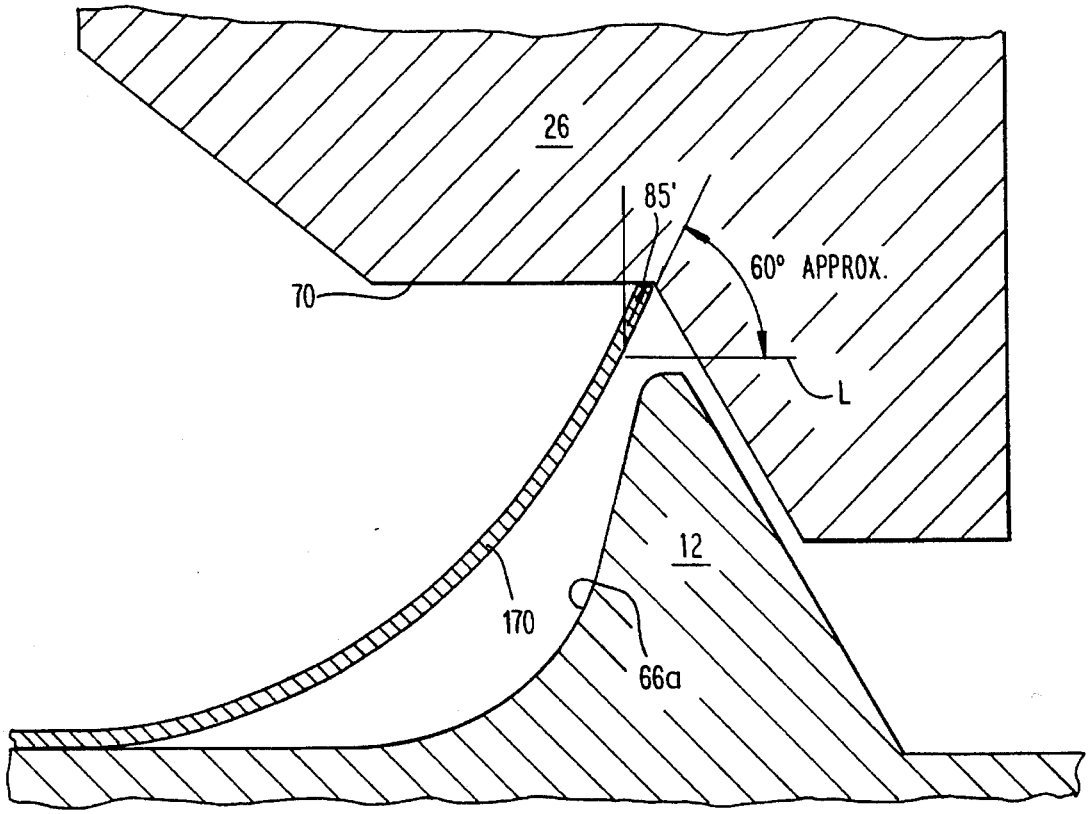
FIG. 4 is an enlarged sectional view similar to FIG. 2 but depicting an improperly formed free edge portion avoiding contact with both the roller flanging forming surfaces and the stop ring corner.

As mentioned above, the free edge portion 66 of a spin flow necked can 164 may sometimes be misformed to have the configuration depicted in FIG. 4 wherein the free edge 170 forms an angle of approximately 60° with the container longitudinal axis L instead of a desired angle in the range of 70°–75°. Consequently, this smaller angle creates an axial resistance load which frequently overcomes the predetermined spring force as the base pad 152 moves through and completes its working stroke without ever or completely contacting the flange forming surfaces **66*a* to obtain the desired FIG. 2** completed flange orientation.

Figure 5:
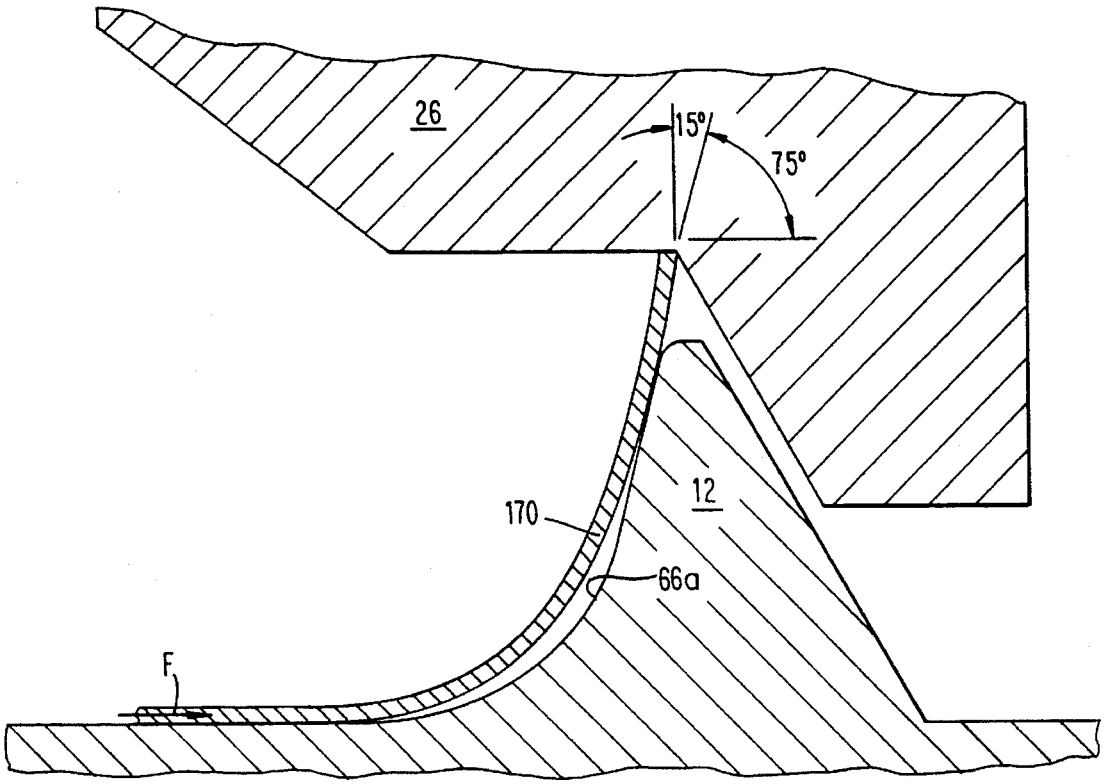
FIG. 5 is a view similar to FIGS. 2 and 4 but depicting the flange in a transitional phase as it is reformed from the FIG. 4 into the FIG. 2 position with the working spring gap of the invention.

To prevent this occurrence, and assuming now that the misformed free edge portion 170 is in the FIG. 4 position, the base pad assembly 150 according to the present invention is modified to include a series of stop spacers 180 respectively mounted on the springs 158 between the front face 178 of the adjusting collar 156 and the rear face 176 of the base pad 152. The stop spacers 180 may be loosely mounted within the gap formed between the opposing front and rear faces 178, 176 of the collar 156 and base pad 152, respectively. The identical thickness of each spacer 180 is less than the normal spacing between the collar 156 and the base pad 152 to define a working spring gap 185 which is slightly greater than the normal variation in trimmed can height. Therefore, the working spring gap 185 in the preferred embodiment is usually about 0.005–0.015 inch, and preferably 0.010 inch. As the base pad assembly 150 is advanced forwardly in its working stroke and the misformed free edge 170 of the can contacts the stop corner 85', the axial resistance loading overcomes the predetermined spring force which locks the base pad 152 in a fixed axial position as the shank 160 continues to advance. This in turn causes the working spring gap 185 to close as the advancing front faces 180a of the stop spacers 180 contacts the rear face 176 of the base pad 152. Once completely closed, the pushing force of the spacers 180 acting on the base pad 152 causes the latter to continue to advance the free edge portion 170 of the can 164 in an axially forward direction. This overriding or overpowering force F (FIG. 5), which is greater than the predetermined spring force, causes the free edge portion 170 to begin to deform into contact with the roller flange forming surfaces 66*a*. It also causes the free edge of the can 164 to assume a steeper angle relative to the can longitudinal axis L. As the steeper angle approaches about 75°, the lessening axial resistance loading is eventually overcome by the predetermined spring force.

As the spindle 160 continues its travel, the flange is now weaker than the predetermined spring force in the base pad 152. At this point, the spring-loaded base pad 152 takes over and forces the can 164 rapidly into complete contact with the rotating spinners 12. As this occurs, i.e., the base pad 152 moves the free edge portion from the FIG. 5 into the FIG. 2 position, the base pad tends to move forward relative to the spacers 180' to begin to restore the working spring gap 185. The spring force now causes the can 164 to maintain contact with the stop ring 26 while the rotating spinners 12 complete the flange forming process and sizing of the can neck.

As the cam operated shank 160 approaches completion of its working stroke, the can flange would now be locked into the stop ring corner 85' in the manner depicted in FIG. 2 and the working spring gap 185 may be closed slightly.

The stop spacers 180 disposed between the adjusting collar 156 and base pad 152 to define a working spring gap 185 is a preferred embodiment. However, it is to be understood that other mechanisms may be utilized in either the base pad assembly 150 or in the flanging head assembly to provide a working spring gap that is only wide enough to accommodate the normal variation that would be expected in finished can height but narrow enough to prevent the free end of the spin flow necked can from overpowering the spring biased base pad and thereby passing through the flanging apparatus without being completely flanged. Therefore, the working spring gap, in accordance with the invention, is selected and defined such that when the predetermined spring force in a flanging apparatus is insufficient to urge the free edge portion into full contact with the flanging surfaces, a force which is greater than the predetermined spring force can close the working spring gap and operate to continue the relative axial movement between the base pad and flanging head assembly to thereby deflect the free edge portion into sufficient contact with the forming surfaces to initiate completion of full contact with the forming surfaces. Optimally, after the free edge portion is deflected into such sufficient contact with the forming surfaces under the action of the force which is greater than the predetermined spring force, the greater force is removed and the predetermined spring force is restored to initiate completion of full contact between the free edge portion with the flange forming surfaces.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A flanging apparatus, comprising:

(a) at least one flanging head assembly for forming a peripheral outwardly directed flange in a free edge portion of a can having a cylindrical can body, said assembly including a plurality of flanging rollers having profiled flange forming surfaces adapted to receive said free edge portion and spin same in a radially outward direction during relative axial movement of said free edge portion toward and against progressively larger diameter portions of said forming surfaces; a housing arrangement for mounting said flanging rollers about a central longitudinal axis thereof; a spinning arrangement for revolving said rollers about said central longitudinal axis to create spinning contact with said relatively axially advancing free edge portion, and a stop ring having a stop surface mounted adjacent a trailing end of said forming surfaces to contact the free edge of the flange as it moves off the forming surfaces to limit the diameter of the flange; and (b) a spring loaded base pad assembly including a base pad adapted to contact the can bottom, a spring pad adjusting collar interconnected to the base pad through at least one spring having a predetermined spring force, and a spindle connected to the spring pad adjusting collar and being operable to axially advance the open end of the can body in a forward stroke of the spindle into flanging contact with the flanging rollers by advancing the base pad with the can bottom seated thereon toward the flanging head assembly;

wherein said spring-loaded base pad assembly further includes a stop spacer, mounted between the adjusting collar and the base pad to define a gap therebetween, said predetermined spring force being normally sufficient during the forward stroke to urge the free edge portion of the can into contact with both the stop ring and into full contact with the profiled flange forming surfaces, without the gap being completely closed so as to form the flange, said spacer being dimensioned to close the gap during the forward stroke when said predetermined spring force is insufficient to urge the free edge portion into contact with both the stop ring and into full contact with the profiled flange forming surfaces, so that the base pad is directly moved by the spacer to deflect the free edge portion into sufficient contact with the flange forming surfaces such that the predetermined spring force is now operable to urge the free edge portion into said full contact.

2. The apparatus of claim 1, further including a step formed in the stop ring which spaces the stop surface from the forming surfaces to enable the terminal end of the flange being formed to travel past an interface crack between the roller and stop ring and across the step to contact the stop surface and avoid movement of a portion of the terminal end of the flange into the crack.

3. The apparatus of claim 2, further comprising a flanging turret carrying said at least one flanging head assembly, and a base pad turret carrying said base pad assembly, said turret being rotatable about a common axis.

4. The apparatus of claim 3, wherein said step and stop surface form a sharp interior corner to capture and trap the flange end thereagainst.

5. The apparatus of claim 2, wherein said step and stop surface form a sharp interior corner to capture and trap the flange end thereagainst.

6. The apparatus of claim 2, wherein said step has a radial width of about 0.010–0.040 inches.

7. The apparatus of claim 2, further comprising a plurality of said stop spacers respectively associated with a plurality of said springs.

8. The apparatus of claim 2, wherein said gap is a working spring gap formed between the spacer and the base pad.

9. The apparatus of claim 1, further comprising a plurality of said stop spacers respectively associated with a plurality of said springs.

10. The apparatus of claim 1, wherein said gap is a working spring gap formed between the spacer and the base pad.

11. The apparatus of claim 1, wherein said predetermined spring force is between about 75 to 110 pounds.

12. The apparatus of claim 1, wherein said gap width is selected to be only slightly larger than the normal variation in finished can height.

13. The apparatus of claim 12, wherein said gap width is approximately 0.010 inches.

14. A flanging apparatus, comprising:

(a) at least one flanging head assembly having profiled flange forming surfaces adapted to receive a free edge open end portion of the can body and form same into a flange in at least substantially full contact with said flange forming surfaces during relative axial movement between said free edge portion and said forming surfaces, and a stop ring having a stop surface mounted adjacent a trailing end of said forming surfaces to contact the free edge of the free edge portion to limit the diameter of the flange during forming;

(b) a base pad assembly adapted to contact the can bottom; and (c) a spring arrangement disposed in at least one of said flanging head assembly and said base pad assembly and a working spring gap formed between opposing surfaces in said spring arrangement across which gap at least one spring extends, such that said relative axial movement causes forming to occur under a predetermined spring force which is normally sufficient to urge the free edge portion into contact with the stop ring and into said full contact with the profiled flange forming surfaces against the stopping action of the stop surface and without the gap being completely closed during a working stroke which causes said relative axial movement, whereby said gap is dimensioned to fully close when the predetermined spring force is insufficient to urge the free edge portion into contact with both the stop ring and into full contact with the forming surfaces, so that one of the opposing surfaces contacts and moves the other opposing surface to continue said relative axial movement and thereby deflect the free edge portion into sufficient contact with the forming surfaces to initiate completion of the said full contact with the forming surfaces.

15. The apparatus of claim 14, wherein said gap is operable to re-open as a result of a weakening of the axial resistance force of the free edge portion to a force level which is less than said predetermined spring force.

16. The apparatus of claim 15, wherein said stop ring further includes a step which spaces the stop surface from the forming surfaces to enable the terminal end of the flange being formed to travel past an interface crack between the flange forming surfaces and the stop ring and across the step to contact the stop surface and avoid movement of a portion of the terminal end of the flange into the crack.

17. The apparatus of claim 16, wherein said spring arrangement is disposed within the base pad assembly which includes a base pad adapted to contact the can bottom, a spring pad adjusting collar interconnected to the base pad through at least one said spring having said predetermined spring force, and a spindle connected to the spring pad adjusting collar and being operable to axially advance the open end of the can body in said forward stroke of the spindle into flanging contact with the forming surfaces by advancing the base pad with the can bottom seated thereon toward the flanging head assembly.

18. The apparatus of claim 17, wherein said predetermined spring force is between about 75 to 110 pounds and wherein said gap width is selected to be only slightly larger than the normal variation in finished can height.

19. A method of forming a peripheral, outwardly directed flange in a free edge portion of a can having a cylindrical body, comprising the steps of:

(a) positioning the can body in a flanging apparatus between a flanging head assembly and a base pad assembly contacting a can bottom; and (b) flanging said free edge portion by creating relative axial movement between said free edge portion with profiled flange forming surfaces in said flanging head assembly under a resilient predetermined spring force which is normally sufficient to urge the free edge portion into full contact with the profiled flange forming surfaces, wherein, when the predetermined spring force is insufficient to urge the free edge portion into said full contact with the forming surfaces, a force which is greater than the predetermined spring force operates to continue said relative axial movement and thereby deflect the free edge portion into sufficient contact with the forming surfaces to initiate completion of the said full contact with the forming surfaces.

20. The method of claim 19, wherein, after the free edge portion is deflected into sufficient contact with the forming surfaces under the action of the force which is greater than said predetermined spring force, said greater force is released and said predetermined spring force is restored to initiate completion of the said full contact with the forming surfaces.

* * * * *